US005328433A

United States Patent [19]

Berman

[11] Patent Number: 5,328,433

[45] Date of Patent: Jul. 12, 1994

[54] PROGRESSIVE ABDOMINAL EXERCISE DEVICE

[76] Inventor: Jerald A. Berman, 20 Jones Rd., Warwick, N.Y. 10990

[21] Appl. No.: 98,773

[22] Filed: Jul. 29, 1993

[51] Int. Cl.[5] ..... A63B 21/02; A63B 21/04

[52] U.S. Cl. ..... 482/122; 482/129; 482/124

[58] Field of Search ..... 482/121, 122, 123, 124, 482/125, 126, 128, 129, 130; 267/89, 175, 177, 182

[56] References Cited

U.S. PATENT DOCUMENTS

| | | | |
|---|---|---|---|
| 799,270 | 9/1905 | Roland . | |
| 1,023,756 | 4/1912 | Pons . | |
| 1,734,238 | 11/1929 | Sweeney . | |
| 2,202,202 | 5/1940 | Hesse | 84/465 |
| 3,029,076 | 4/1962 | Andersen | 272/67 |
| 3,215,429 | 11/1965 | Shaboo et al. | 272/80 |
| 3,953,026 | 4/1976 | Stokely | 272/140 |
| 3,966,204 | 6/1976 | Dubach | 272/135 |
| 3,992,004 | 11/1976 | Feron et al. | 272/141 |
| 4,026,548 | 5/1977 | Birdwell | 482/129 |
| 4,079,933 | 3/1978 | Everroad | 272/121 |
| 4,121,827 | 10/1978 | Weider | 272/137 |
| 4,245,840 | 1/1981 | Van Housen | 272/137 |
| 4,376,533 | 3/1983 | Kolbel | 272/137 |
| 4,411,426 | 10/1983 | McCoy et al. | 272/126 |
| 4,456,249 | 6/1984 | Calabrese | 272/139 |
| 4,540,173 | 9/1985 | Hopkins, Jr. | 272/139 |
| 4,588,186 | 5/1986 | Calabrese | 272/126 |
| 4,735,412 | 4/1988 | Prsala | 272/138 |
| 4,736,946 | 4/1988 | Gordon | 272/137 |
| 4,762,318 | 8/1988 | Phillips et al. | 272/137 |
| 4,815,731 | 3/1989 | Suarez et al. | 272/139 |
| 4,889,336 | 12/1989 | Schneiderman | 272/137 |
| 4,909,505 | 3/1990 | Tee | 272/142 |
| 4,911,426 | 3/1990 | Scales | 272/70 |
| 5,046,726 | 9/1991 | Van Straaten | 272/141 |

FOREIGN PATENT DOCUMENTS

| | | | |
|---|---|---|---|
| 2055592 | 3/1981 | United Kingdom | 482/129 |
| 2056866 | 3/1981 | United Kingdom . | |

*Primary Examiner*—Stephen R. Crow

*Attorney, Agent, or Firm*—Jacobson, Price, Holman & Stern

[57] ABSTRACT

A muscle is exercised by orienting the body such that the muscle must be flexed to support a part of the body from falling under its weight. The strength of the muscle is supplemented by a device which provides an adjustable resistance, and the resistance is progressively reduced as the muscle is strengthened. The preferred device includes a spring and structure to adjustably compress the spring and to arrange it between selected parts of the user's body.

5 Claims, 2 Drawing Sheets

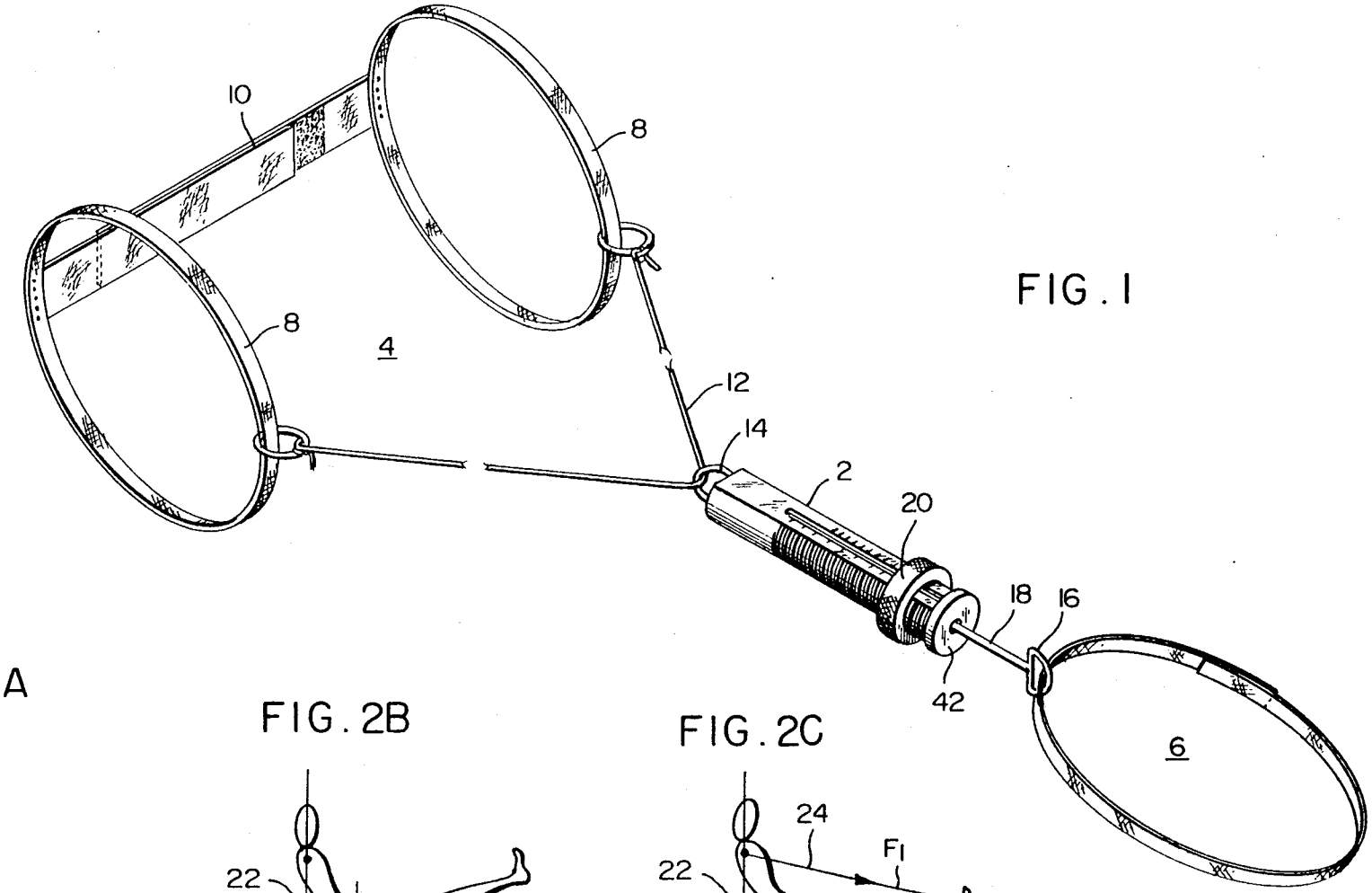
FIG. 1
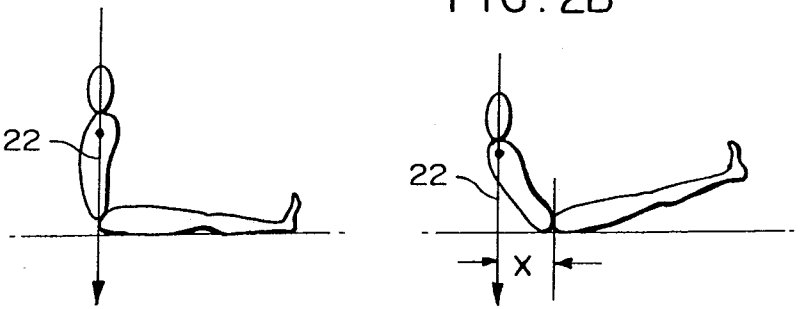
FIG. 2A
FIG. 2B
FIG. 2C

PROGRESSIVE ABDOMINAL EXERCISE DEVICE

TECHNICAL FIELD

This invention relates to the art of exercise devices. In the preferred embodiment, an exercise device capable of providing variable resistances is used in a method of exercising the abdominal muscles.

BACKGROUND

Many devices and methods are known for use in exercising nearly all muscles of the human body. Most of these require the muscle being exercised to flex to operate the device. Many employ a spring or other device which acts in tension and require the user to pull the ends of the device apart to exercise the muscle.

Other forms of exercise are known which employ no assisting apparatus at all. For example, the sit-up is a well known exercise for developing the abdominal muscles.

The above forms of exercise are generally known as "dynamic" because the body parts are moving during the exercise. Another form of exercise, however, is known as "isometric" because the muscle is required to flex but is not required to move. For example, the position wherein one is supported with the hands while the feet are held in front of the body requires the abdominal muscles to be flexed while maintaining them stationary. This requires a significant amount of abdominal strength and is of value as an exercise only to those with such strength.

SUMMARY OF THE INVENTION

In accordance with the invention, a method and apparatus for it implementation are provided wherein the isometric type of exercise is made available to those who do not possess the strength required to sustain a body part in an orientation against the force of gravity. The device of the invention supports a body part against the force of gravity, and in the preferred embodiment, extends between two parts of the body. Because the force can be varied, the strength required of the muscle to support the body part can be continuously increased, resulting in progressive exercise of the muscle.

The preferred device according to the invention comprises a spring which is under adjustable tension. The spring is maintained in a tubular housing, one end of which is attached to a rope and a harness for being applied to the shoulders of the user. One end of the spring engages a key movable with respect to the housing, and a rod engages the other end of the spring. The rod is attached to a ring for engaging the feet of the user. The spring thus provides an adjustable force and may easily be placed between the shoulders and the feet of the user.

In operation, the preferred apparatus is attached between the shoulders and feet while the user is sitting on the floor and in such a manner that the feet remain on the floor while the upper torso is leaned back. The body is held in this position by the combined forces of the spring and the flexure of the abdominal muscles. The spring compression is arranged so that it assists the user to whatever level the muscle is able to hold the body in position, and this is adjusted in subsequent exercises as the abdominal muscles get stronger.

The exercise technique of the invention may be applied to muscles other than the abdominal muscles. Many muscles can be exercised by orienting the body such that the muscles must be flexed to support a body part. A variable force device such as that described herein can then be placed between that body part and another object in accordance with an exercise program described below. Moreover, adjustable force devices other than specifically described here are within the contemplation of the invention. For example, the device may be hydraulic, pneumatic or otherwise.

While the preferred adjustable force device extends between opposed parts of the body of the user, it is possible to arrange the device between one of the body parts and another object such as the floor or a wall. In the abdominal muscle exercise described below, an adjustable resistance support could be arranged between the back of the user and the floor.

BRIEF DESCRIPTION OF THE DRAWINGS

FIG. 1 is a perspective view of the preferred apparatus according to the invention.

FIGS. 2A–2C are schematic diagrams illustrating a principle for using the invention.

DETAILED DESCRIPTION OF THE INVENTION

Figure 3:
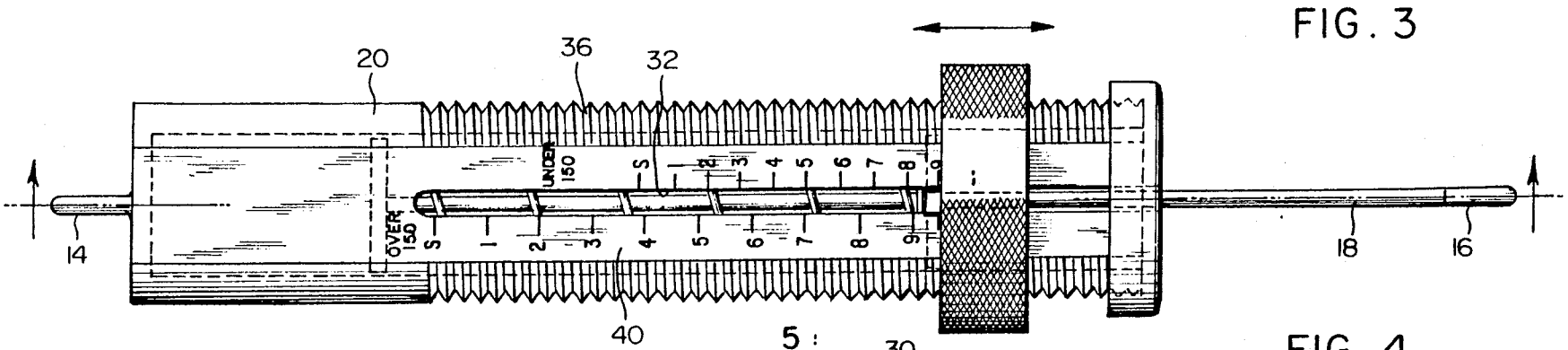
FIG. 3 is a top view of the housing of the device shown in FIG. 1.

With reference to FIG. 1, a preferred apparatus of the invention comprises an intermediate length portion tubular housing for providing an adjustable resistance, a first end portion shoulder harness 4, and a second end portion foot ring 6. The shoulder harness 4 includes two loops 8 which receive the arms and shoulders of the user and a strap 10 of adjustable length to provide a comfortable fit. The front of each of the loops 8 is attached to a respective end of a rope 12 which is threaded through an eye 14 of the housing 2. The ring 6 passes through an eye 16 of a rod 18, the structure of which will be described with respect to FIGS. 3 and 4.

An adjusting nut 20 is threaded on the housing 2 for adjusting the effective static length of the intermediate length portion housing portion 2 and the force which must be applied to cause movement between the rod 18 and the eye 14. Also, once the nut 20 has been adjusted generally half way along the tube 2 toward eye 14, the force required to compress the spring 26 may be increased without shortening the effective static distance between eyes 14 and 16. The purpose of this structure for the exercise of the abdominal muscles is best explained with the aid of the diagrams shown in FIGS. 2A through 2C.

FIG. 2A illustrates the situation where a person is sitting on the floor with the torso generally vertical and the lower limbs generally horizontal. In this orientation, the force tending to rotate the torso about the legs is zero or very small because the force of gravity (weight) as depicted by the arrow 22 passes through or is very close to the hip joint which is the connection between the torso and the legs. This means that the torque about the hips is very small.

FIG. 2B illustrates a position wherein the torso is slanted such that the weight of the torso applies a force displaced from the hips by a distance "x". This creates a torque about the hips which the abdominal muscles must counteract if the position is to be maintained. If the abdominal muscles do not supply the requisite force, the torso will continue to rotate in the counterclockwise direction until the person is lying flat on the floor. If the abdominal muscles of the person are strong enough to maintain this position for an extended period of time, this can be used as an isometric exercise for these muscles by increasing the length of time that the position is maintained.

A problem arises, however, when the muscles are not strong enough to maintain the position shown in FIG. 2B. In such a case, this cannot be used as an isometric exercise because the torso rotates through the position of FIG. 2B. Accordingly, the apparatus of the invention has been developed and is used as shown in FIG. 2C.

In FIG. 2C the apparatus shown in FIG. 1 is attached to the shoulders and feet to create a force $F_1$ as illustrated by the arrow 24. This force is adjusted by movement of the nut 20 such that it is just adequate to supplement the force supplied by the abdominal muscles to counteract the torque caused by the weight of the torso as described with respect to FIG. 2B. Thus, the abdominal muscles may be isometrically exercised by attaching the device of FIG. 1 between the torso and feet, assuming the position shown in FIG. 2C, and adjusting the supplementary force such that the abdominal muscles are just capable of maintaining the position. This is preferably done in stages, and the housing is provided with indicia indicating the position of the adjusting nut 20 to permit the force to be reliably adjusted.

Figure 4:
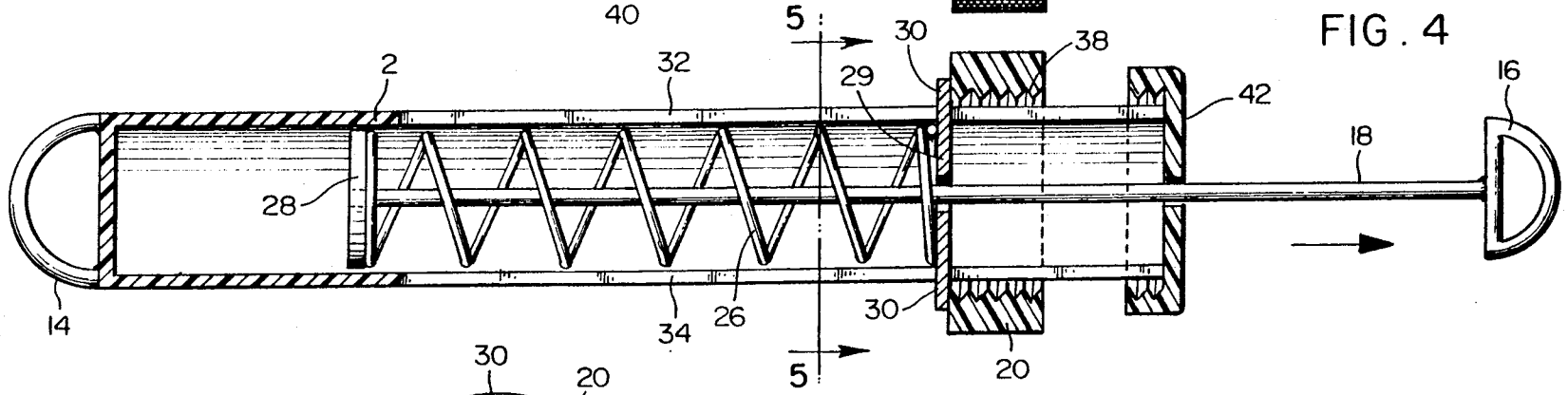
FIG. 4 is a longitudinal cross section of the housing shown in FIG. 3.
Figure 5:
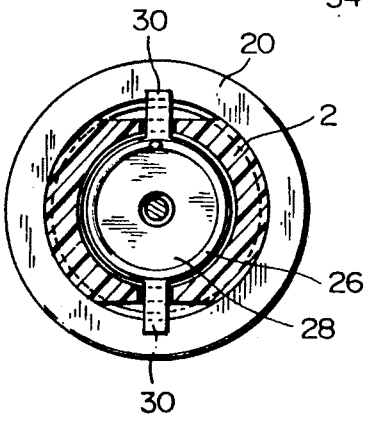
FIG. 5 is a transverse cross section of the housing taken along line 5—5 of FIG. 4.

The details of the mechanism for providing an adjustable force are shown in FIGS. 3 through 5. The housing 20 is hollow and carries a spring 26. One end of the spring is engaged by a plate 28 which is secured to an end of the rod 18. The rod 18 extends along the length of the spring and passes through its center such that a force applied to the eye 16 by the feet of the user will pull upon the end of the spring.

The other end of the spring is engaged by a key 29 which is movably mounted in the housing 20. The key 29 has a flat part for engaging the spring and ears 30 which extend through slots 32 and 34 in the housing 2. The key is pressed against the adjusting nut 20 by the force of the spring, and the degree of compression of the spring is determined by the location of the nut along the housing. The housing 2 is provided with threads 36 which cooperate with threads 38 on the nut whereby the position of the nut on the housing may be adjusted by rotation of the nut with respect to the housing.

The housing has a flat part 40 adjacent the slot 32 which contains indicia for allowing the position of the nut to be set in accordance with an organized exercise program. As shown in figure 3, the indicia are preferably arranged to provide two sets of gradations to accommodate users of different sizes. For example, one set of gradations may be used by those weighing in excess of 150 pounds and another set for those weighing less.

The device is assembled by providing a threaded cap 42 at one end of the housing 2 through which the spring, rod, and key may be inserted with the cap removed.

In use, the apparatus of FIG. 1 is attached to a user such that the user's finger tips are just able to touch the tops of the knee caps. The nut is adjusted to provide an assisting force which makes it possible to maintain this position for five minutes. The level of assistance is then reduced each week as the abdominal muscles grow stronger.

Modifications within the scope of the appended claims will be apparent to those of skill in the art.

I claim:

1. Exercise apparatus comprising adjustable force means for providing an adjustable resistance between first and second locations thereof, first means for attaching said first location of said adjustable force means to a body part of a user in such an orientation that said adjustable resistance will assist in supporting said body part, second means for attaching said second location to a second body part, said adjustable force means comprising a compression spring and means for adjustable compression of said spring, said adjustable force means including means for securing said first attachment means to one end of said spring, means for securing said second attachment means to a second end of said spring, and means for adjusting the distance between said first and second ends of said spring, said means for securing said first attachment means to one end of said spring comprising a tube surrounding said spring and means for engaging said one end of said spring and for adjustable movement with respect to said tube, said means for securing said second attachment means to a second end of said spring comprises a rod which extends longitudinally through said spring, and said means for adjusting comprises means for moving along said tube and for securing a location of said means for engaging said one end of said spring with respect to said tube.

2. Exercise apparatus according to claim 1 wherein said tube has indicia thereon for indicating the location of said means for engaging.

3. Exercise apparatus according to claim 1 wherein said first means for attaching comprises means for engaging the shoulders of said user.

4. Exercise apparatus according to claim 3 wherein said second means for attaching comprises a loop for receiving the feet of said user.

5. An exercise apparatus for effecting adjustable force and muscle contraction isometric exercises, said apparatus comprising an elongated assembly having opposite end portions and intermediate length portion disposed between said end portions, one of said end portions including first anchor means for anchoring to a first movable body part of a user and said second end portion including second anchor means adapted to be anchored stationary relative to a second body part of the user, said intermediate length portion including spring means connecting said end portions offering yieldable resistance to increases in the spacial relation of said end portions, and adjustment means operable in a first mode of adjustment to simultaneously adjust the effective static length of said intermediate length portion and the force required to increase the effective length thereof and further operable in a second mode of operation thereof to adjust the force required to increase the effective length of said intermediate length portion independent of adjustment of the static length thereof.

* * * * *